United States Patent [19]

Mikhail

[11] Patent Number: 5,014,931

[45] Date of Patent: May 14, 1991

[54] KINETIC ENERGY PROJECTILE WITH IMPACT-EJECTED FINS

[75] Inventor: Ameer G. Mikhail, Bel Air, Md.

[73] Assignee: The United States of America as represented by the Secretary of the Army, Washington, D.C.

[21] Appl. No.: 574,337

[22] Filed: Aug. 29, 1990

[51] Int. Cl.[5] ..... F42B 10/14

[52] U.S. Cl. ..... 244/3.25; 102/517; 102/703

[58] Field of Search ..... 102/517, 521, 703; 244/3.24–3.3

[56] References Cited

U.S. PATENT DOCUMENTS

| | | | |
|---|---|---|---|
| 3,687,398 | 8/1972 | Beuschel | 244/3.24 |
| 3,935,817 | 2/1976 | Riparbelli | 102/374 |
| 4,671,181 | 6/1987 | Romer et al. | 102/521 |
| 4,730,561 | 3/1988 | Schaake | 102/517 |

*Primary Examiner*—Harold J. Tudor

*Attorney, Agent, or Firm*—Saul Elbaum; Muzio B. Roberto

[57] ABSTRACT

A kinetic energy projectile intended to be launched toward a selected target has a projectile body and a plurality of fins attached to the projectile body to provide stablity thereto in flight. Means are provided for causing the fins to be ejected from the projectile body upon impact with the target and for retaining the fins on the body in flight. The latter includes a fin support structure fastened to the body and including a locking mechanism for releasably securing the fins thereto, the fins including fasteners arranged and adapted to cooperate with the locking mechanism in releasably securing the fins to the fin support structure. In the preferred embodiment, the locking mechanism includes a plurality of channels each having a closed end, and the fasteners are a plurality of pins fastened to the fins for insertion into the channels up to said closed ends thereof. Premature ejection of the fins from the projectile body is prevented, for example, by the application of a special putty material to partially fill the channels.

2 Claims, 2 Drawing Sheets

KINETIC ENERGY PROJECTILE WITH IMPACT-EJECTED FINS

RIGHTS OF THE GOVERNMENT

The invention described herein may be manufactured, used and licensed by or for the United States Government for governmental purposes without the payment to me of any royalty thereon.

BACKGROUND OF THE INVENTION

The present invention relates generally to anti-armor weaponry, and more particularly to kinetic energy projectiles having fins which are arranged and adapted to be ejected from the projectile body on impact with the target.

Typically, kinetic energy projectiles are launched from gun tubes of tanks or other weaponry tubes against enemy tanks or other hard targets to cause total, or at least partial destruction and thereby disable the target. Damage to the target is caused solely by the kinetic energy ($\frac{1}{2}\times$mass$\times$velocity$^2$) of the projectile, because the projectile contains no explosive charge. Such projectiles are fin-stabilized, and therefore, are designed to maintain a flat target trajectory with high velocity (usually Mach 5 or higher, equal to 5500 feet per second, approximately, at sea level) for short flight durations (e.g., from one to three seconds). By the time impact occurs, the projectile has been heated to sufficiently high temperature as a result of its velocity, shape and travel distance. The force of the impact tends to cause the projectile to penetrate the target structure at the point of impact and to cause the target to disintegrate into fragments capable of igniting the impacted tank's fuel and shells. A direct hit will usually cause an explosion or sufficient damage to be disabling, even if the target is not completely destroyed.

FIG. 1 shows a typical prior art kinetic energy projectile 10. The body 11 has a relatively large overall length to diameter (L/D) ratio and the forward portion 12 of the body is usually pointed. The projectile has surface groovings 13 and at least one set of multiple fins 14. The fins reduce the total armor penetration depth of this type of weaponry because of the direct physical obstruction at impact with the target. Nevertheless, fins are essential for in-flight stabilization of the projectile motion. Consequently it has been necessary to sacrifice some of the destructive force of the projectile attributable to the presence of the fins, for the sake of assuring accurate hits while seeking to reduce the pitching and/or yawing (lateral) motion of the projectile in flight which may cause oblique (instead of head-on) impact with the target.

It is desirable to increase the L/D ratio of the projectile, to increase its lethality; but it is not unusual for longer L/D projectiles to suffer decreased depth of penetration of the target because of rod bending of the projectile body at even small oblique angles of impact. The prevalence and extent of bending of the longer L/D (e.g., ratios greater than 20) projectiles is exacerbated with fins of heavier mass, causing a cantilever-type of body bending and even less target penetration. It would be desirable to reduce the fin mass or even to eliminate the fins altogether, if this could be done without sacrificing in-flight stability of the projectile, to reduce the body bending and increase the penetration depth of long L/D projectiles, thereby enhancing the lethality of the weapon.

It is a principal object of the present invention to increase the lethality of finned kinetic energy projectiles by achieving deeper penetration.

In the past, penetration of the target by the projectile body has been accompanied by use of fins of lighter weight or lighter density, such as aluminum rather than steel. However, such lower density fin materials are vulnerable to the aerodynamic heating associated with high launch speeds exceeding Mach 5 which otherwise could further enhance penetration and improve the ballistics and accuracy of the projectile.

It is a more specific object of the present invention to improve penetration of the kinetic energy projectile body into the target by providing the projectile with fins that are designed to withstand high velocity launch temperatures, exhibit lower drag force in flight, and be ejected upon impact of the projectile with the target.

SUMMARY OF THE INVENTION

The present invention is primarily intended to provide an improved kinetic energy projectile by increasing its streamlining through fin reduction, giving the projectile of a longer L/D ratio, ability to withstand aerodynamic heating associated with higher launch velocities, and increasing the depth of penetration of the projectile body into the target, than have been attainable with prior art kinetic energy projectiles. Such an improved projectile is more lethal, which, of course, is a principal purpose of a weapon of war.

As in the prior art, the kinetic energy projectile to be launched toward a selected target has a projectile body and a plurality of fins attached to the projectile body to provide stability thereto in flight. According to the invention, however, means are provided for retaining the fins on the body at launch and in flight, and for causing the fins to be ejected from the projectile body upon impact with the target. In a presently preferred embodiment, such means include a fin support structure fastened to the projectile body and including a locking mechanism for releasably securing the fins thereto, the fins including fasteners arranged and adapted to cooperate with the locking mechanism in releasably securing the fins to the fin support structure. The locking mechanism includes a plurality of channels each having a closed end, and the fasteners are a plurality of pins fastened to the fins for insertion into the channels up to the closed ends thereof.

Premature ejection of the fins from the projectile body is prevented by the application of a special putty material to partially fill the channels. Upon impact of the projectile with the target, however, the fins and their attached pins continue to move forward through the inertia force. The pins, upon impact, cause fragmentation of the putty material and continue movement along a path through the channels designed to eject the fins away from the projectile body.

Thus, the present invention enables ridding the projectile of its fins at the moment of impact, after they have served the function of in-flight stabilization. In this manner, the fins cause no physical obstruction for the penetration process, and the ejected fins also act as shrapnels, thus increasing the destructive outcome of the weapon. The design is both simple and effective, using existing forces (inertia) to separate the fins from the body. No devices are used which would increase complexity, weight and cost, and reduce reliability, such as detonation charges, timers, time-delay devices, or electrical or electronic circuitry. The fins are ejected only upon impact of the projectile with the target, through fin inertia forces imparted by the moving projectile. Moreover, the invention does not create any complications of the projectile configuration or its launching system.

The attachment of the fins to the body according to the invention allows the fins to withstand both the launch inertia force and the in-flight drag force (as well as centrifugal force attributable to projectile spin, if any, during flight). Both of these forces are in the backward direction relative to the movement of the projectile. At impact, however, the inertia forces on the fins are in the forward direction, the same as the direction of penetration of the projectile body. The design is intended to offer little resistance to continued movement of the fins in the forward direction (or along an angled path) at impact, so that they are cleanly ejected.

BRIEF DESCRIPTION OF THE DRAWINGS

The above and still further objects, features, aspects and attendant advantages of the invention will be better understood and appreciated from a consideration of the following detailed description of a presently preferred embodiment, taken in conjunction with the accompanying drawings in which.

DETAILED DESCRIPTION OF THE PREFERRED EMBODIMENT

Figure 1:
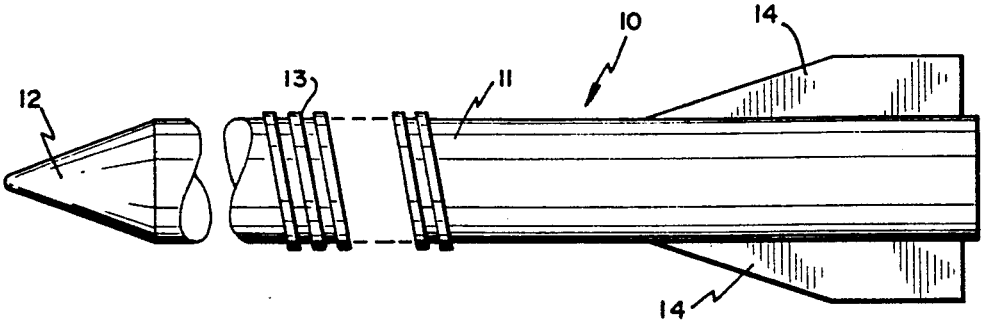
FIG. 1 PRIOR ART
FIG. 1 is a side view of a typical finned kinetic energy projectile, described above.
Figure 2A:
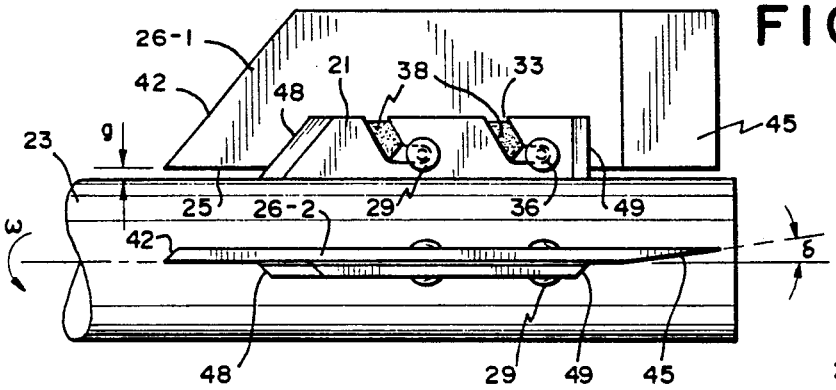
FIGS. 2*a* and 2*b* are a fragmentary side view and end view, respectively, illustrating a presently preferred embodiment of an impact-ejected fin configuration according to the invention.
Figure 2B:
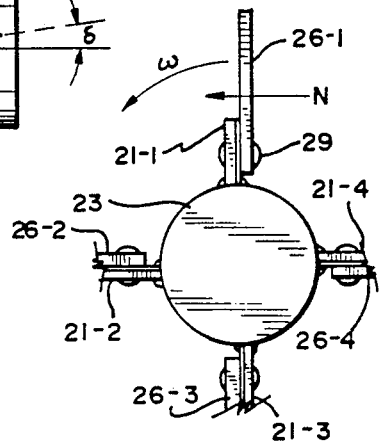
Figure 3:
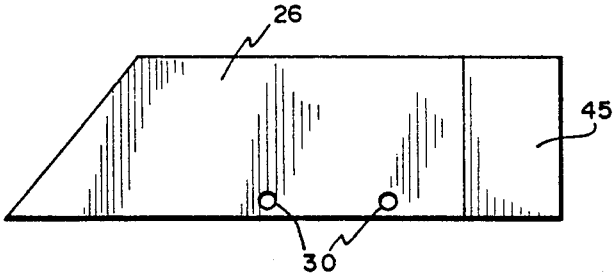
FIG. 3 is a side view of the fin panel (or sheet) of the embodiment of FIG. 2.
Figure 4:
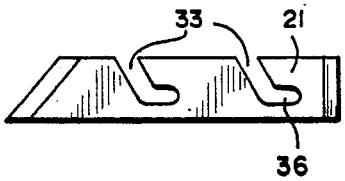
FIG. 4 is a side view of the fin support structure of the embodiment of FIG. 2.

Referring now to FIGS. 2*a* and 2*b*, a presently preferred embodiment of a design configuration and assembly for impactejected fins of a kinetic energy projectile according to the invention are illustrated therein. A fin support portion 21 (shown separately in FIG. 4), which may be formed and machined from sheet metal such as steel, is attached to a fin assembly piece or directly to the body 23 of the projectile by any suitable means, such as by welding. A fin 26 (shown separately in FIG. 3) in the form of a sheet of metal, preferably steel, and of conventional shape, is attached to fin support portion 21 by means of suitable fasteners, such as pins or rivets 29. Although only two pins are shown, it will be understood that the number of pins may be greater depending on the size of the fin and other factors. It will also be recognized that the number of fins used on the projectile may vary as desired, notwithstanding that four are shown symmetrically positioned on the projectile body for the preferred embodiment.

The shaft of each pin extends through a respective slightly larger hole 30 (FIG. 3) in the fin 26, and is of sufficient length and diameter to be inserted into the opening of a respective one of a pair of channels 33 in the fin support 21 (FIG. 4), and to be retained therein, together with the associated fin, by the heads at either end of the pin shaft. In the retained position, the fin surface resides directly against the confronting surface of the support 21, to assure that it is held in a position perpendicular to the plane tangent to the surface of the projectile body at which the fin support is attached. In the assembled condition, the base of the fin is spaced from the surface of the body 23 by a distance 25 (gap g in FIG. 2*a*) to accommodate the weld fillet, if any. The appropriately dimensioned pins are secured to and held captive in the holes 30 of the fin before assembly with the fin support.

The channels are angled downwardly and rearwardly relative to the projectile body 23, for reasons which will be explained presently, and terminate in a smooth arc in end portions 36 in which the pins reside for easy sliding therein when the assembly is complete. After each fin is assembled in secured relationship with the support 21, with the pins retained in the end portions 36, means are provided to prevent premature ejection of the fins from the projectile body, that is, to maintain the assembly together until sufficient force is applied to the fins to cause them and the pin fasteners to be ejected from the channels 33.

In particular, in the preferred embodiment of the invention each of the channels is partially filled with a putty material 38 (FIG. 2*a*) having the following properties. The putty is selected to be sufficiently pliable in its original state to bond easily to the metal surfaces of the fin and the support in the region of the channel, and set up quickly to be sufficiently firm so that it does not yield easily to pressure, whereby to assure its retention in the channel and to prevent the fin from sliding out of its assembly with the support during handling, transportation and storage of the projectile. Further, the putty is selected to have the property that, after setting, it is sufficiently brittle to shatter into fine pieces at impact as the pin moves forward in the channel under the force imparted thereon upon impact with the target. The putty should retain its after-setting properties of hardness and brittleness, so that it does not become extremely harder, softer, more brittle or easily chipped with aging over a considerable period of time, in the range, for example, of thirty to forty years. This assures that the fin assembly will remain in place for loading and launching and during flight of the projectile despite a potentially lengthy period of storage before use in combat. Finally, the putty may be burnable as it is subjected to the intense heat inside the gun tube during launch, but should not emit corrosive gases or other by-products during burning that could damage the inner surface of the gun tube.

A suitable putty material, for example, is Omega CC High Temperature Cement, which is produced by Omega Engineering, Inc. of Stamford, Conn., and is a candidate material for use in the presently preferred embodiment of the invention. It will be observed from FIG. 2*a* that the putty 38 does not completely fill the respective channel 33; rather, an empty space is left in the vicinity of the pin 29.

As shown in FIG. 2*a*, each of the fins 26 has a sharp leading edge 42. Each of the fins may also have a canted surface 45 at the trailing end thereof, inclined at an angle $\delta$ to generate the rolling (i.e., spinning) motion $\omega$ of the projectile in flight. Such spinning occurs, if the projectile is launched from a smooth-bored gun tube, by the rolling moment about the axis of symmetry of the projectile because of the normal force N (FIG. 2*b*) generated as the difference between the pressure forces acting on the canted surface 45 and the back surface of the fin. Surface 45 is positioned relative to the associated fin support 21 so that the direct contact between the confronting surfaces of the fin and the fin support causes transmission of the rolling force. Fin support 21 has a leading edge 48 and a trailing edge 49 compatible with the inside facing surface of the associated fin.

Figure 5A:
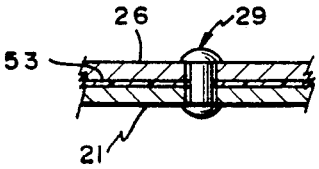
FIGS. 5*a* and 5*b* are fragmentary section views of the fin/fin support assembly taken through the pin and channel, illustrating different configurations of the fastening thereof.
Figure 5B:
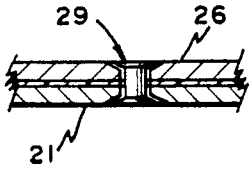

The heads of the pin 29 may either protrude from the outer surfaces of the fin 26/fin support 21 assembly, as shown in FIG. 5*a*, or may be recessed into the metal sheet material of the assembly, as is preferred if the sheet thicknesses permit such a design, as shown in FIG. 5*b*. Also, the confronting surfaces of the fin support 21 and fin 26 are coated (or one of them is coated) with a thin, non-rusting, non-sticking layer 53 (such as Teflon, trademark of DuPont) to prevent rusting or sticking of the design during long periods of storage of the projectile. Similarly, the pins are coated with the same material for the same purpose stated above.

Figure 6:
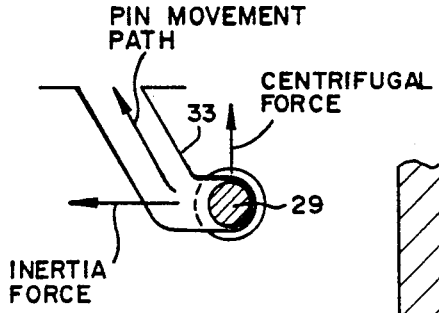
FIGS. 6 is a fragmentary section view through the pin shaft, illustrating the forces acting on the pin and the direction of movement thereof on impact of the projectile with the target.
Figure 7A:
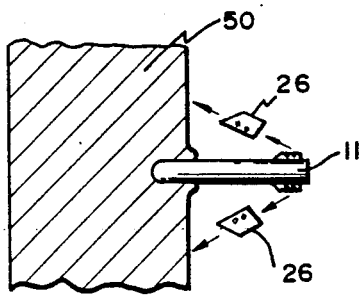
FIGS. 7*a* and 7*b* are simplified diagrams showing ejection of the fins on impact of the projectile, and the resulting deeper penetration of the projectile body into the target.
Figure 7B:
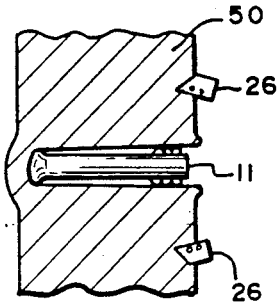

As described above, the channels 33 have closed ends 36 which are parallel to the axis of the projectile. As illustrated in FIG. 6, the closed end secures the pin against radial movement from centrifugal forces attributable to any spinning motion of the projectile during flight, and also bears the backward forces on the fins at launch and during flight, essentially locking the fins in place against those forces. The smooth curve between the main body of the channel and its closed end, however, causes the pins to move forward and upwardly relative to the projectile axis, along that path, at the moment of impact, thereby ejecting the fins 26 at an angle to the body. This is shown in FIG. 7*a*, and the resulting deeper penetration of the projectile 11 into the target 50 is shown in FIG. 7*b*. While ejection of the fins away from the body is preferred, the channels may instead be cut such that they are entirely parallel to the projectile axis, which would cause the fins to be ejected straight ahead relative to the movement of the projectile on impact. To that end, both of the pins would lie in a single channel in the fin support structure.

Figure 8A:
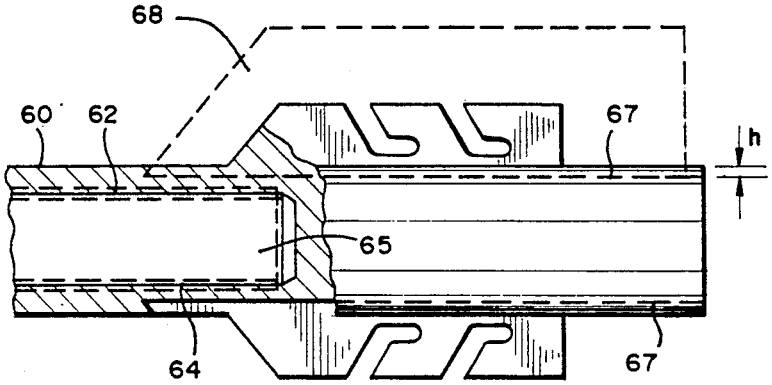
FIGS. 8*a* and 8*b* are side and end views, respectively, of an alternative embodiment of the invention.
Figure 8B:
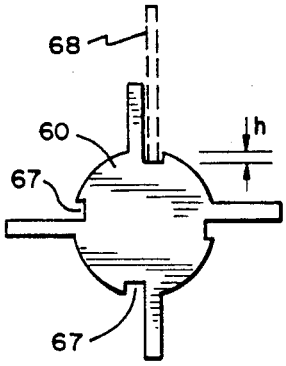

To alleviate any possible degradation of fin performance attributable to the air gap g (FIG. 2*a*) between the base of the fin and the projectile body, the gap may be eliminated by the design of an alternative embodiment of the invention shown in FIGS. 8*a* and 8*b*. In this embodiment, a cylindrical fin support structure 60 is utilized, the structure having a drilled and tapped cavity 62 into which the threaded end 64 of the projectile body 65 is screwed. The support structure 60 has longitudinal grooves 67 parallel to the axis of the projectile extending to a depth h from the surface of the structure. The fins 68 are inserted into grooves 67, and secured to an otherwise identical fin support assembly to that of the previously described embodiment, thereby eliminating any air gap between the fin base and the projectile body or support piece.

Figure 9A:
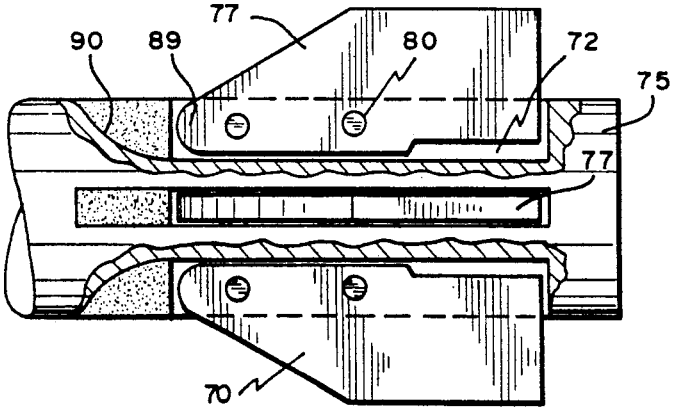
FIGS. 9*a* and 9*b* are a side view, partly in section, and an end view, respectively, of still another embodiment of the invention.
Figure 9B:
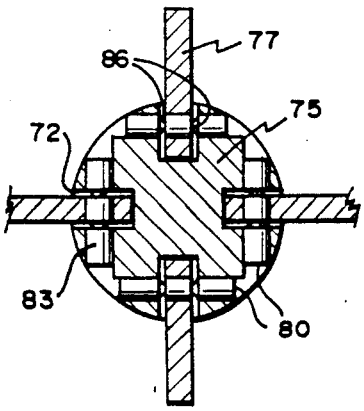

Finally, FIGS. 9*a* and 9*b* illustrate yet another alternative embodiment of the invention for eliminating any air gap between the fin base and the projectile body. Moreover, this embodiment eliminates any upstanding fin support structure relative to the outline of the projectile body, and the increased drag forces attributable to that structure. In this embodiment, longitudinal slots 72 are cut into and near, but not up to, the trailing edge of the projectile body 75, sufficient to accommodate insertion of fins 77 therein. Holes 80 are drilled laterally through the body 75 and slots 72 for insertion of shear pins 83 therethrough and through mating apertures in the assembled fins. The shear pins are provided with weakening notches 86 to allow shearing of the pins on impact of the projectile with the target. The pins and holes are dimensioned to provide a tight fit, and the fins are further secured against the back end of the respective slots.

The lower part of each fin 77, which is positioned in the slot 72, has a rounded leading front edge 89, and the front end 90 of the slot is curved. This assures that the fins will be ejected cleanly away from the projectile body when the pins 83 are sheared at the moment of impact. The space between the rounded front of the fin and the curved portion of the slot is preferably partially filled with putty material of the type described above, for streamlining as well as to assist in preventing premature ejection of the fin. The streamlining prevents an increase in drag and eliminates a cause of unsteady air flow oscillation. A very small gap is provided between the putty and the front edge of the fin to enhance shattering of the putty on impact.

In essence, the fin support structure of the embodiment of FIG. 9 is an integral part of the projectile body, and the assembly locking is accomplished by both the pins and the back ends of the slots holding the fins.

Although certain preferred embodiments of the invention have been shown and described herein, it will be apparent to those skilled in the relevant art that variations and modifications of these embodiments may be implemented without departing from the true spirit and scope of the invention. Accordingly, it is desired that the invention be limited only as required by the appended claims and applicable rules of law.

What is claimed is:

1. A kinetic energy vehicle comprising a projectile body having a plurality of fins attached thereto to provide stability in flight;

means for causing the fins to be ejected from the body upon impact with a target, including means for restraining the fins on the projectile body in flight;

the restraining means comprising fin support means fastened to the projectile body and including locking means for releasable securing the fins thereto, the fins including means arranged and adapted to cooperate with said locking means in releasable securing the fins to the support means;

the locking means including a plurality of channels each having a closed end having cooperating means including a plurality of pins fastened to the fins for insertion in the channel up to the closed end thereof; and a putty material positioned in the channel to prevent the premature ejection of the fins from the locking means of the fin support means;

so that upon impact of the projectile on the target, the fins are ejected from the projectile.

2. A finned vehicle having a projectile body and a plurality of fins;

means attaching the fins to the projectile body to provide in-flight stability, including means for restraining the fins at launch and in-flight of the projectile, in conjunction with forces acting on the projectile during launching and flight thereof;

the restraining means including means for ejecting said fins from the projectile body upon impact with the target, whereby to enhance the depth of penetration of the projectile body into the target;

the restraining means including means for supporting the fins, and means for securing the fins to the support means;

the support means including a plurality of separate structures attached to said projectile body for supporting respective one of the fins, each of the structures including channels, and said securing means including pins fastened to respective one of said fins for holding the respective fin in the channel of the associated one of the structure in a deployed position.

* * * * *